US011400472B2

(12) United States Patent
Zembrod

(10) Patent No.: US 11,400,472 B2
(45) Date of Patent: Aug. 2, 2022

(54) DISPENSER DEVICE WITHOUT AIR INTAKE FOR APPLICATOR NOZZLES FOR VARIOUS TYPES OF FLEXIBLE PACKAGING

(71) Applicant: Eric Zembrod, Boituva (BR)

(72) Inventor: Eric Zembrod, Boituva (BR)

( * ) Notice: Subject to any disclaimer, the term of this patent is extended or adjusted under 35 U.S.C. 154(b) by 76 days.

(21) Appl. No.: 17/251,704

(22) PCT Filed: Jun. 12, 2019

(86) PCT No.: PCT/BR2019/050219

§ 371 (c)(1),
(2) Date: Dec. 11, 2020

(87) PCT Pub. No.: WO2019/237171

PCT Pub. Date: Dec. 19, 2019

(65) Prior Publication Data

US 2021/0114048 A1 Apr. 22, 2021

Related U.S. Application Data

(63) Continuation of application No. PCT/BR2018/050189, filed on Jun. 12, 2018.

(51) Int. Cl.

| | |
|---|---|
| ***B05B 11/04*** | (2006.01) |
| ***B05B 11/00*** | (2006.01) |
| ***B05B 9/08*** | (2006.01) |

(52) U.S. Cl.

CPC ..... *B05B 11/047* (2013.01); *B05B 9/0838* (2013.01); *B05B 11/007* (2013.01);
(Continued)

(58) Field of Classification Search

CPC . B05B 9/047; B05B 9/0838; B05B 11/00412; B05B 11/007; B05B 11/047;
(Continued)

(56) References Cited

U.S. PATENT DOCUMENTS

| | | | |
|---|---|---|---|
| 3,229,866 | A | 1/1966 | Arbitman et al. |
| 6,685,062 | B1 | 2/2004 | Ki |

(Continued)

FOREIGN PATENT DOCUMENTS

| | | |
|---|---|---|
| BR | 102014016690 | 2/2016 |
| WO | WO 2019/237162 | 12/2019 |

OTHER PUBLICATIONS

International Search Report dated Dec. 5, 2018 International Application No. PCT/BR2018/050189.

(Continued)

*Primary Examiner* — Ryan A Reis
(74) *Attorney, Agent, or Firm* — B. Aaron Schulman, Esq.; Stites & Harbison, PLLC

(57) ABSTRACT

DISPENSER DEVICE WITHOUT AIR INTAKE FOR NOZZLES FOR VARIOUS TYPES OF FLEXIBLE PACKAGING, with an outlet chamber (1) that is hermetically controlled by a plug (2), an elastomeric valve (3) and an elastic pad (18); the vertical outlet chamber (1) is defined by a cylindrical capsule (4) and any nozzle (5) together with an internal elastomeric mass (6); the lower capsule (4) has a sealing seat (7) housing the plug (2), which works jointly with an elastic pad (18), so that between it and the lower capsule (4) a passage is formed for the product to be dispensed; the lower capsule (4) and the nozzle (5) are combined with variable parts (8*a*) and (8*b*) coupling with the nozzle (9) of any flexible container (10); the plug (2) is housed in the sealing seat (7) with enough clearance to be moved up and down when internal pressure occurs or ceases inside the flexible container (10) and allows the product to pass through the sealing seat (7) or to close it tightly; the elastomeric valve (3) has an elastic opening point (11) designed to open and close when the pressure inside the flexible container is interrupted or present (10).

10 Claims, 5 Drawing Sheets

(52) U.S. Cl.
CPC ..... *B05B 11/0072* (2013.01); *B05B 11/0075* (2013.01); *B05B 11/00412* (2018.08)

(58) Field of Classification Search
CPC ..... A45D 33/005; A45D 33/02; A45D 34/04; A45D 34/042; A45D 40/26; A45D 40/261; A45D 2200/051; A45D 2200/054
See application file for complete search history.

(56) References Cited

U.S. PATENT DOCUMENTS 6,745,781 B2 6/2004 Gueret
6,793,431 B1 9/2004 Tsai
6,962,273 B2 11/2005 Masuda
7,309,184 B2 12/2007 Butcher et al.
7,425,102 B1 * 9/2008 Velliquette ..... B05C 1/00 401/271
7,824,124 B2 11/2010 Francavilla et al.
7,938,298 B2 5/2011 Lee
8,052,016 B2 11/2011 Wang
8,226,319 B2 7/2012 Francavilla et al.
8,499,970 B2 8/2013 Yoo
8,622,254 B2 1/2014 Kang
8,631,975 B2 1/2014 Lim
8,690,022 B2 4/2014 Lee
8,714,857 B1 5/2014 Liu
8,863,988 B2 10/2014 Kang
8,881,946 B2 11/2014 Lee et al.
9,226,562 B2 1/2016 Delmon et al.
2002/0014254 A1 2/2002 Gueret
2002/0090247 A1 7/2002 Breidenbach et al.
2003/0057236 A1 3/2003 Delage
2003/0230600 A1 * 12/2003 Masuda ..... B05B 11/00416 222/321.7
2007/0009318 A1 1/2007 Kuo et al.
2008/0107476 A1 * 5/2008 Byun ..... B65D 35/36 401/280
2011/0278328 A1 11/2011 Kang
2013/0108349 A1 5/2013 Thorpe
2014/0356045 A1 * 12/2014 Thiebaut ..... A45D 34/04 401/196
2016/0324295 A1 * 11/2016 Lee ..... A45D 34/041
2017/0143096 A1 5/2017 Zembrod
2017/0233172 A1 8/2017 Gaudillot
2017/0265624 A1 * 9/2017 Wilson ..... A45D 34/04
2018/0289222 A1 * 10/2018 Nilsson ..... B05B 11/3035
2019/0224705 A1 * 7/2019 Lee ..... B05B 11/047

OTHER PUBLICATIONS

Written Opinion dated Dec. 5, 2018 International Application No. PCT/BR2018/050189.
International Search Report dated Sep. 12, 2019 International Application No. PCT/BR2019/050219.
Written Opinion dated Sep. 12, 2019 International Application No. PCT/BR2019/050219.
Office Action dated Feb. 22, 2022 in Canadian Application No. 3,103,302.

* cited by examiner

DISPENSER DEVICE WITHOUT AIR INTAKE FOR APPLICATOR NOZZLES FOR VARIOUS TYPES OF FLEXIBLE PACKAGING

FIELD OF THE INVENTION

The present invention relates to a variety of packages used to dispense or apply various products in a fluid state, whether they are cosmetics, drugs, food or chemicals, notably semi-solids and liquids.

More particularly, the present Invention relates to application PCT BR2018050189, filed on Jun. 12, 2018, and it is defined, initially, by an outlet chamber, vertical and hermetically controlled by two extremity valve blocks, the lower one constituting a "cup" shaped plug and the upper one forming an elastomeric valve. The exit chamber with the two locks is mounted inside any nozzle which, in turn, includes means to be coupled to the end of a necessarily flexible packaging body like tube in order to be pressed. The two valve blocks work according to the internal pressure of the flexible body, that is, when pressing said flexible body, an internal pressure is created and, consequently, its contents are forced to flow into the outlet chamber. In this phase, the lower plug is moved in order to open the passage for the product, which, in turn, moves along the outlet chamber and then stresses the elastomeric valve, at which point the product is ejected in a controlled manner according to the desired amount. After that, when the flexible body of the package is no longer pressed, an opposite effect occurs, that is, the memory of the material of the package's flexible body tries to return to its original position and practically inverts that pressure. After that, a suction effect is produced and, at this point, the two extremity blocks of the outlet chamber defined by the lower plug and the elastomeric valve return to the initial watertight closing state. This watertight effect achieved by the two blockages works exclusively in conjunction with the portion of the product maintained inside the outlet chamber. This portion also functions as a third "plug" and constitutes an element that guarantees the water tightness of the two blockages, keeping them in the closed and watertight position defined together with the suction provided by the flexibility of the package's flexible body.

Therefore, the application PCTBR2018050189, filed on Jun. 12, 2018, provides an automatic sealing system that works through the negative pressure generated inside the bottle. The bottle performs suction on the valve through a plug (2) to the closed position (bottle memory generates negative pressure) and, consequently, the plug (2) is displaced downwards or to be seated on the sealing seat (7) of the cylindrical capsule (4), thus generating the watertightness of the mechanism.

An important detail described in PCTBR2018050189 is that the automatic sealing system occurs only after the FIRST USE of the packaging, that is, the desired negative pressure occurs after the first pressing of the bottle or first use, consequently, after the packaging is made available for sale, the internal pressure of the packaging is atmospheric, that is, the same as when it was bottled, therefore, at that moment there is no negative pressure inside the packaging capable of promoting suction (negative pressure) and moving the valve or plug (2) according to a desired pressure up to the closed (sealed) position.

Therefore, it would be desirable for there to be an automatic seal also after the packaging is filled and before its first use.

In view of the above, the packaging described in application PCTBR2018050189 was modified to perform an automatic seal immediately after the packaging is filled. To meet this new feature, an elastic pad was inserted between the valve or plug and the fixed nozzle part. The elastic pad has the function of a spring, that is, it remains "compressed" in the assembly, consequently, it has sufficient expansion force to keep the valve or plug pressed against its sealing seat, ensuring the desired watertightness right after the filling of the packing. Said elastic pad also presents elasticity that enables it to be compressed by the valve itself when first used and subsequent uses, because, when the packaging is pressed, the internal pressure promotes the displacement of the valve enough so that it moves away from its sealing seat and, concomitantly, the product flows to the dispensing nozzle. Once the internal pressure has ceased, the packaging memory, as already mentioned, promotes the suction and displacement of the valve until it returns to its original watertight position. In this last phase, the sealing occurs automatically due to the presence of suction, however, the elastic pad also expands, which generates a faster and more precise sealing.

An elastic pad means any component with parts capable of being compressed and stretched elastically, such as a spring of any material and shape, elastomeric parts, flexible plastic parts and/or others.

DESCRIPTION OF THE DRAWINGS

For a better understanding of the present invention, a detailed description is given below, making reference to the attached drawings, all of which are exemplary.

DETAILED DESCRIPTION OF THE INVENTION

Figure 1:
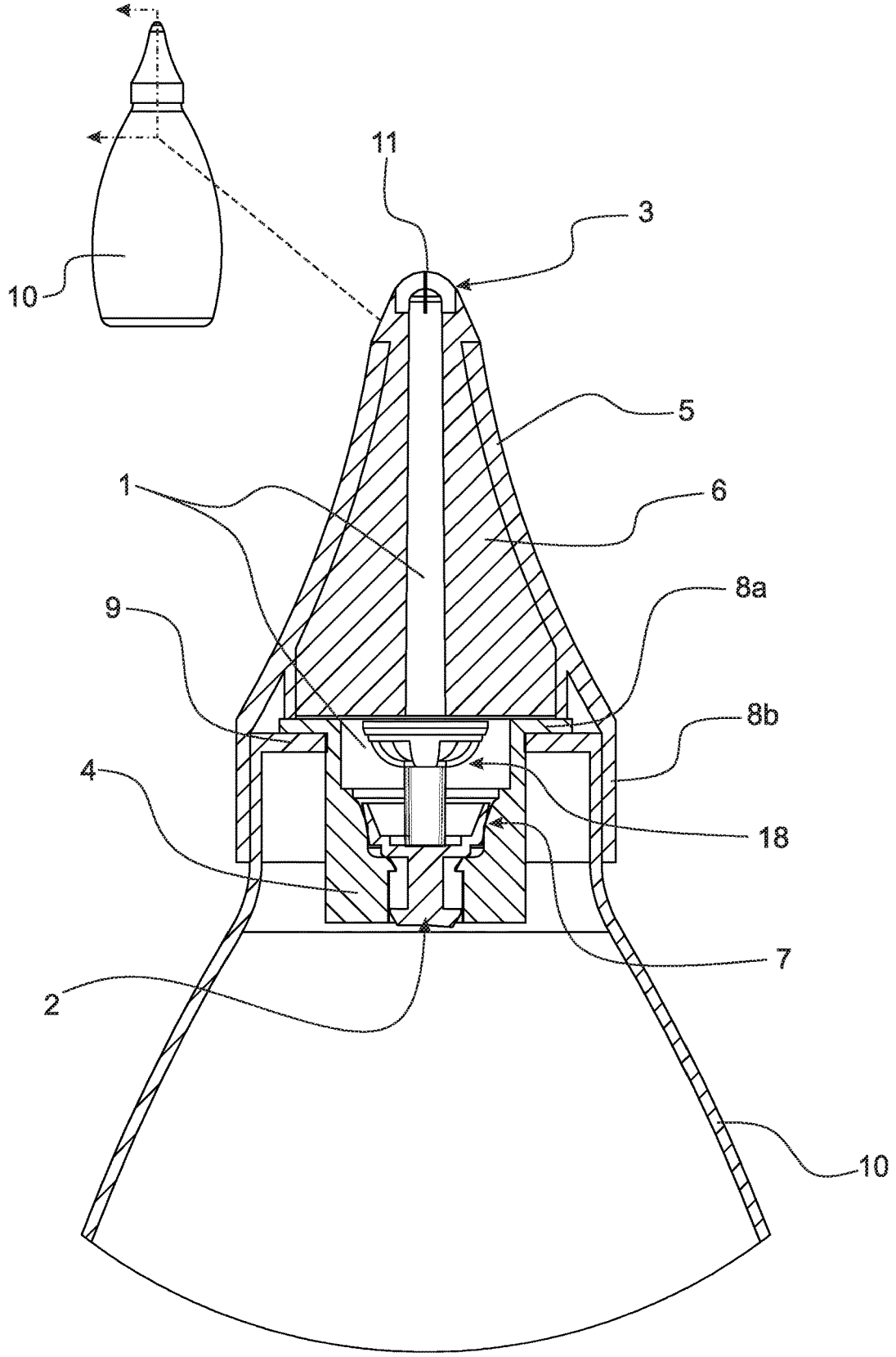
FIG. 01 represents a cross-sectional view, schematically showing the present invention assembled in an exemplary package.
Figure 2:
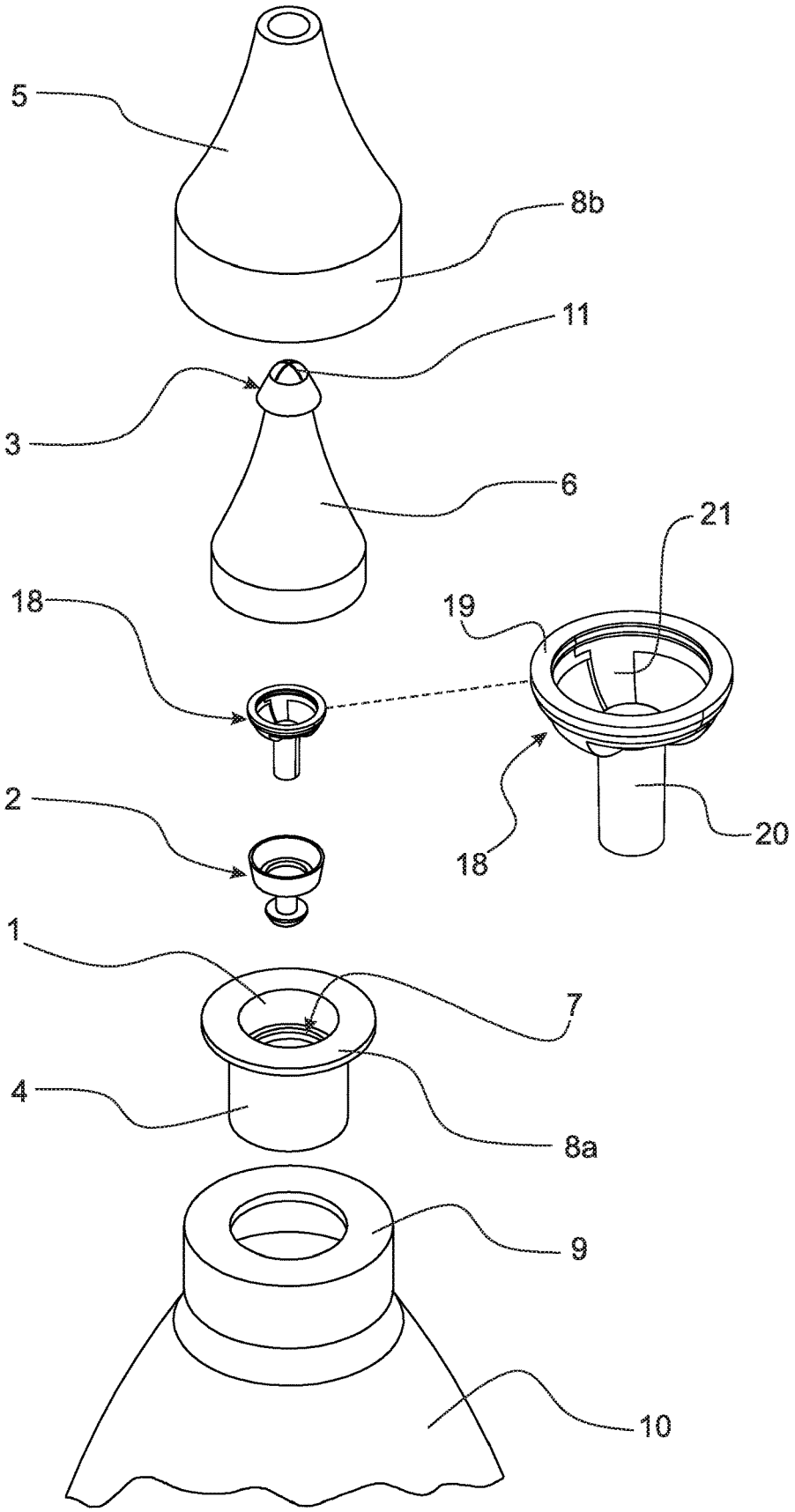
FIG. 02 shows an exploded perspective at a higher angle, schematically showing the components that form the present device.
Figure 3:
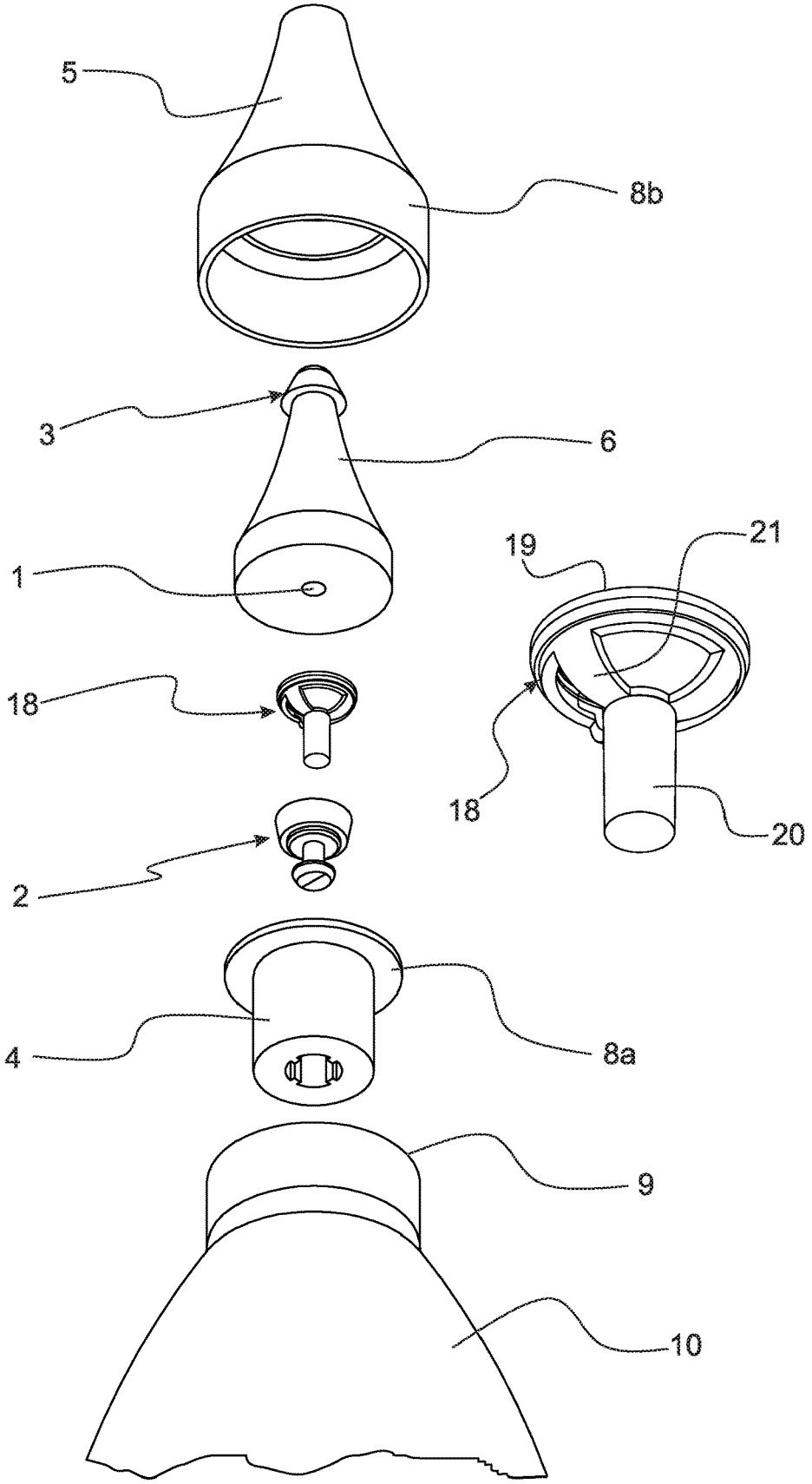
FIG. 03 illustrates another exploded perspective schematically showing the components that make up the present device, but at a lower angle.

According to these illustrations and in their details, more particularly the FIGS. 1 to 3, the present Invention, DISPENSER DEVICE WITHOUT AIR INTAKE FOR NOZZLES FOR VARIOUS TYPES OF FLEXIBLE PACKAGING, comprises:

- an outlet chamber (1) that is vertical, hermetically controlled by two extremity blocks, a lower one in the form of a plug (2) and an upper one in the form of an elastomeric valve (3);
- the vertical outlet chamber (1) being defined by hollow parts of a cylindrical capsule (4), which is lower, and any nozzle (5) together with an internal elastomeric mass (6);
- the lower capsule (4) having a sealing seat (7) housing the plug (2), so that between it and the lower capsule (4) a passage is formed for the product to be dispensed;

the lower capsule (4) and the nozzle (5) are combined with variable parts (8*a*) and (8*b*) coupling to the nozzle (9) of any flexible container (10);

the flexible container (10) can be pressed and must be made of a flexible plastic material with memory to return to its original shape and in order to cause suction inside;

the plug (2) is housed in the sealing seat (7) with enough clearance to be moved up and down when internal pressure occurs or ceases inside the flexible container (10) and allows the product to pass through the sealing seat (7) or close it tightly;

the elastomeric valve (3) has an elastic opening point (11) designed to open and close when there is pressure and when the pressure inside the flexible container is interrupted (10); and the plug (2) and the elastomeric valve (3) return to the watertight position when the flexible container (10) is no longer pressed and its flexible memory tries to return to its original state.

Figure 4:
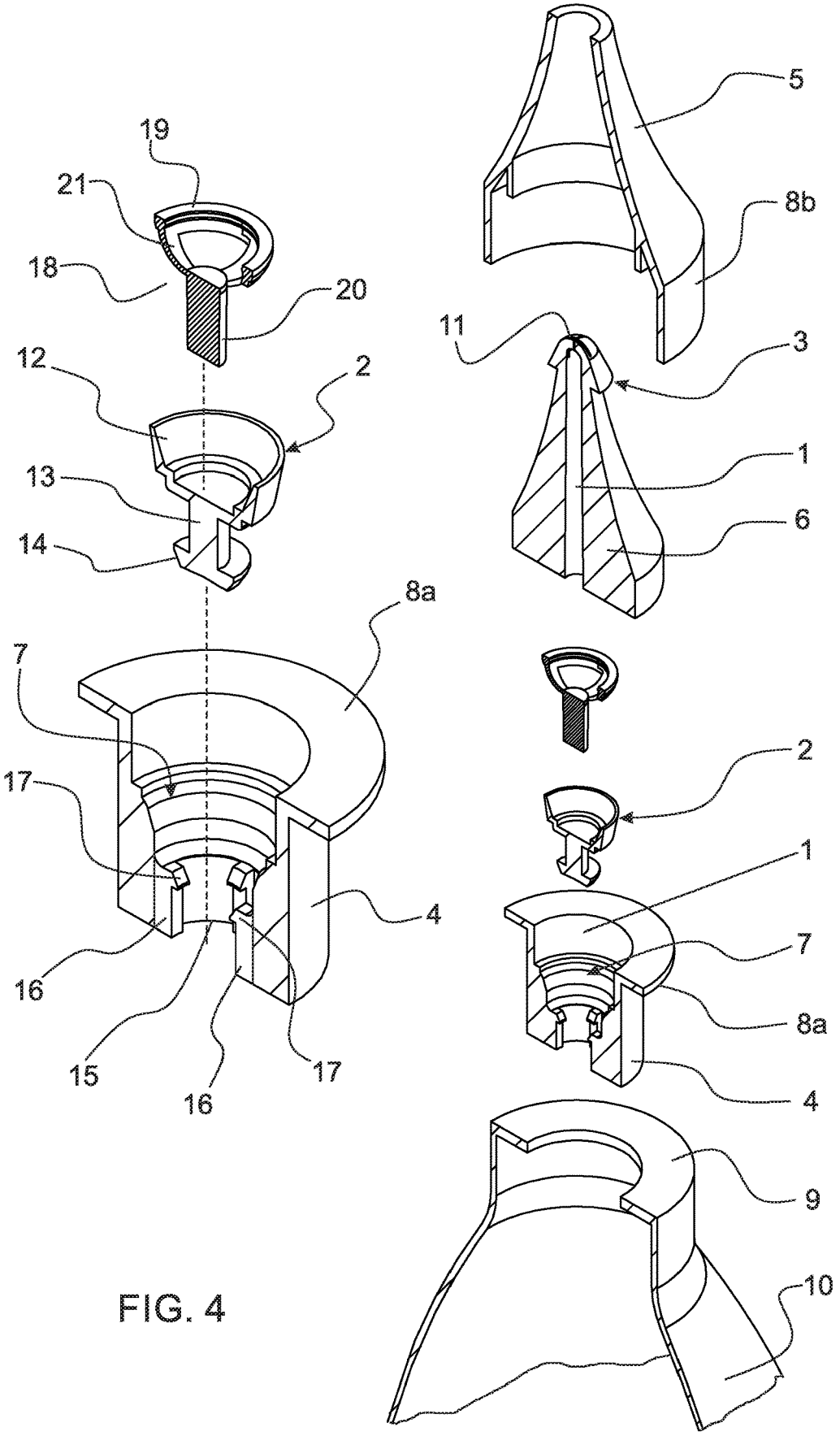
FIG. 04 is an exploded perspective in half section, showing other internal details of the components that make up the device.

As shown in FIG. 4, the plug (2) is made of substantially malleable material and has a cup shape with a truncated upper part (12) in the form of a cup, with the smaller diameter closed and facing downwards, from which it extends vertically to a cylindrical guide (13) that ends at the bottom part in a blind flange (14), also tapered, forming a piece with a profile that allows for it to be accommodated inside the cylindrical capsule (4), which, for this purpose, besides the sealing seat (7), presents its bottom hollowed out by a hole (15), with an internal diameter presenting equidistant radial projections (16), vertical, with upper ends form claws in the form of teeth pointed radially inward (17) and positioned at the upper end of said hole (15), through which the blind flange (14) is forced to pass due to its taper and, after that, the retention occurs; however, that part is liable to be displaced vertically below said teeth, where the mentioned flange (14) has a smaller diameter than the hole (15) and forms a passage for the product. The upper end of the hole (15) widens with several circular bands, one of which is intermediate and forms the sealing seat (7) on which the equally tapered cup-shaped (12) section of the plug (2) fits, and, at this point, the passage or tightness of the product inside the flexible container occurs (10).

All material above from application PCTBR2018050189, filed on Jun. 12, 2018, has been included into this request for better understanding.

As already mentioned, the packaging from PCTBR2018050189 includes an automatic sealing system that works through the negative pressure generated by the container (10). The bottle performs suction on the plug (2) to the closed position and, consequently, the plug (2) is displaced downwards or to be seated on the sealing seat (7) of the cylindrical capsule (4), thus generating the watertightness of the mechanism.

An important detail described in PCTBR2018050189 is that the automatic sealing system occurs only after the FIRST USE of the packaging, that is, the desired negative pressure occurs after the first pressing of the bottle or first use, consequently, after the packaging is made available for sale, the internal pressure of the packaging is atmospheric, that is, the same as when it was bottled, therefore, at that moment there is no negative pressure inside the packaging capable of promoting suction (negative pressure) and moving the valve or plug (2) according to a desired pressure up to the closed (sealed) position.

Therefore, it would be desirable for there to be an automatic seal also after the packaging is filled and before its first use.

In view of the above, the packaging described in application PCTBR2018050189 was modified to perform an automatic seal immediately after the packaging is filled.

To meet this new characteristic, illustrated in FIGS. 1 to 5, an elastic pad (18) was inserted between the plug (2) and the bottom of the nozzle (5), without causing any obstruction in the passage of product through the chamber (1).

The elastic pad (18) is of a spring-type that, after the assembly, remains "compressed", consequently, it has sufficient expansion force to keep the valve or plug (2) pressed against its sealing seat (7), ensuring the desired watertightness right after the filling of the packing.

Said elastic pad (18) also presents elasticity that enables it to be compressed by the plug itself (2) at the first use and subsequent uses, because, when pressing the container (10), the internal pressure displaces the plug (2) enough for it to move away from its sealing seat (7) and, concomitantly, the product flows to the dispensing nozzle. Once the internal pressure has ceased, the packaging memory, as already mentioned, promotes the suction and displacement of the valve until it returns to its original watertight position. In this last phase, the sealing occurs automatically due to the presence of suction, however, the elastic pad also expands, which generates a faster and more precise sealing.

An elastic pad (18) means any component with parts capable of being compressed and stretched elastically, such as a spring of any material and shape, elastomeric parts, flexible plastic parts and/or others.

In a preferred construction, illustrated in said FIGS. 1 to 4, the elastic pad (18) is composed of two integrated parts, being an upper horizontal ring (19) and a lower vertical rod (20), both interconnected by arched and flexible links (21). The elastic pad (18) is mounted inside the assembly with light compression, where the upper ring (19) is supported against the lower side of the nozzle (5), while on the opposite side the vertical rod (20) has its bottom extremity supported on the inside of the plug (2), axially aligned with its cylindrical guide (13).

Figure 5:
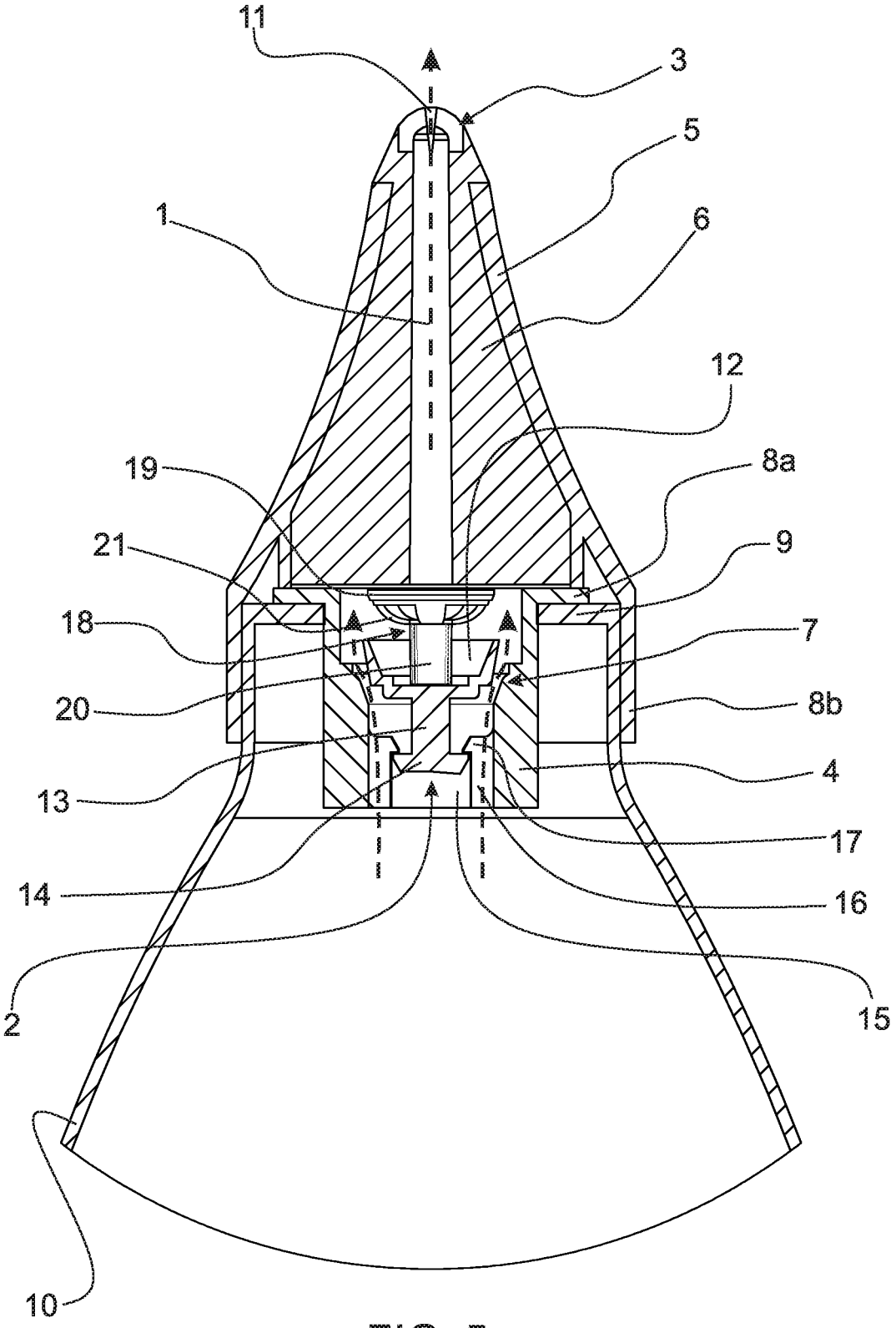
FIG. 05 shows a cross-sectional view similar to that of FIG. 1, however, in this view the valves are open, showing the operation of the assembly.

FIG. 5 schematically shows the operation of the present device, however, looking first at FIG. 1, we can see the sealing system closed and after filling. In this condition, as already mentioned, the elastic pad (18) is slightly compressed by the assembly, consequently, the plug (2) is also lightly pressed against the sealing seat (7) and, therefore, the watertightness is maintained as long as the container (10) is not pressed. In FIG. 5 the automatic sealing system is activated, that is, the container (10) has been pressed, and as such the plug (2), the elastomeric valve (3) and the elastic pad (18) work automatically according to the internal pressure of the flexible container (10), that is, when pressing said flexible container (10) an internal pressure is created and, consequently, its contents are forced to flow to the outlet chamber (1). At this stage, the lower plug (2) is moved away from the sealing seat (7) and, thus, also presses the pad (18), compressing it so that the passage of the product to the outlet chamber (1) can take place and, from this, the product forces the elastomeric valve (3) and its elastic opening (11) opens sufficiently so that the product is ejected in a smooth and controlled fashion according to the desired quantity. With that, when the flexible container (10) is no longer pressed, an opposite effect occurs, that is, the memory of the flexible container material (10) tries to return to its original position, practically inverts that pressure and, with that, it produces a suction effect and, at this moment, the plug (2), the elastomeric valve (3) and the elastic pad (18) return to the initial state of watertight closure (FIG. 1). This watertight effect maintains the suction pressure. This retention effect is carried out in conjunction with the portion of product kept accumulated inside the outlet chamber (1), since such product portion also functions as a sealing complement, becoming a true "plug".

The drawings are merely illustrative, since, as it is known, the packaging itself can present a considerable range of variations and its construction details do not alter the functional concept of the device in question.

The illustrated packaging lacks an overcap, since such a detail does not interfere with the construction of the present device.

For example, the nozzle (5) can have variable external details according to the product and its application.

On the other hand, the lower capsule (4), although illustrated as an independent part, can be integrated into different parts that close the flexible container (10).

After what has been exposed and illustrated, the present device embodies the aforementioned advantages of PCTBR2018050189 and the application in question:

- the automatic sealing system ensures tightness after filling and after the first use, thus solving an inconvenience of the previous device;
- the outlet chamber (1) combined with the plug (2), the elastomeric valve (3) and the elastic pad (18), contributes to the present device being manufactured with a reduced size and, therefore, it can be used in a considerable variety of flexible packaging types, especially those with reduced capacities that cannot receive complex devices such as a pump or similar, prevent the intake of air (air-less).
- the outlet chamber (1) combined with the plug (2) and the elastomeric valve (3) also adds the necessary means to replace complex devices, notably pumps used in other packages with larger capacities;
- the outlet chamber (1) combined with the plug (2), the elastomeric valve (3) and the elastic pad (18), prevents the intake of air and, consequently, preserves the original characteristics of the product and prevents contamination of the portion of product remaining inside the outlet chamber (1);
- the outlet chamber (1) combined with the plug (2) and the elastomeric valve (3), and the elastic pad (18), also features a perfect operation with a variety of products of different aggregation states, semi-solids and liquids, with enhanced fluidity, whether they are cosmetics, drugs, food or chemicals;
- the outlet chamber (1), the plug (2), the elastomeric valve (3) and the elastic pad (18), combined with the remaining part of the product, provide an efficient means for perfect watertight effect and for the precise control of the quantity of product ejected, even avoiding external residual parts, runoff and dripping;
- due to the reduced number of components, that is, the opening and closing are defined by only four components, the outlet chamber (1), the plug (2), the elastomeric valve (3) and the elastic pad (18), as well as due to the fact that said assembly is independent, this allows the device to replace the traditional complex devices without air intake, even with mere dimensional variations it is possible to adapt the assembly so that it can work with products of different viscosities, providing the means necessary for considerable reduction of the final cost of packaging, maintaining the same efficiency when compared to more complex devices designed to prevent air from entering, especially those with springs, plungers and others.

It will be understood that certain characteristics and combinations of the device in question with any nozzle (5) and with any flexible container (10) can vary considerably, maintaining the same functional concept for the assembly; consequently, it is noted that the construction that is hereby described in detail by way of example is clearly subject to constructive variations of such parts; however, this is all within the invention scope revealed initially and defined by an exit chamber, vertical and hermetically controlled by two extremity valve blocks, both driven by the internal pressure of the packaging itself, both at the opening as well as at the watertight closing, and as many modifications can be made in the configuration that is hereby detailed according to the descriptive requirements of the law; it must be understood that the details presented should be interpreted as illustrative and not limiting.

The invention claimed is:

1. A dispenser device without air intake for nozzles for various types of flexible packaging, comprising:

- a vertical outlet chamber hermetically controlled by two extremity blocks, a lower extremity block in the form of a plug and an upper extremity block in the form of an elastomeric valve;
- the vertical outlet chamber being defined by hollow parts of a lower cylindrical capsule and a nozzle together with an internal elastomeric mass;
- the lower capsule has a sealing seat to drive the plug, so that between the plug and the lower capsule a passage can be formed which can be opened or closed for the output or water tightness of a product;
- the plug is kept lightly pressed against the sealing seat through an elastic pad;
- the lower capsule and the nozzle are combined with variable parts coupling to a nozzle of a flexible container;
- the flexible container can be pressed and must be made of a flexible plastic material with memory to return to its original shape and in order to cause suction inside;
- the plug is housed in the sealing seat with enough clearance to be moved up and down when internal pressure occurs or ceases inside the flexible container and allows the product to pass through the sealing seat or close it tightly;
- the elastic pad has enough elasticity to be compressed concomitantly with the displacement of the plug when there is internal pressure in the container;
- the elastomeric valve has an elastic opening point designed to open and close when there is pressure and when the pressure inside the flexible container is interrupted; and
- the plug, the elastomeric valve and the elastic pad return to a watertight position when the flexible container is no longer pressed and its flexible memory tries to return to its original state.

2. The dispenser device without air intake for nozzles for various types of flexible packaging, according to claim 1, wherein the plug, made of a substantially malleable material, presents the shape of a cup with a tapered upper part in the form of a cup, with the smaller diameter closed and facing downwards and from which it extends vertically to a cylindrical guide that ends at the lower part in a blind flange, which is also tapered.

3. The dispenser device without air intake for nozzles for various types of flexible packaging, according to claim 1, wherein the lower cylindrical capsule in the region of the sealing seat, presents a bottom part hollowed out by a hole, whose internal diameter has equidistant radial vertical projections, whose upper ends form claws in the form of teeth that are radially turned inward and positioned at the upper end of said hole which, in turn, expands with several circular bands, in which an intermediate is tapered and forms the sealing seat.

4. The dispenser device without air intake for nozzles for various types of flexible packaging, according to claim 2, wherein the blind flange of the plug is forced from top to bottom inside the lower capsule to pass through radially turned inward teeth.

5. The dispenser device without air intake for nozzles for various types of flexible packaging, according to claim 2, wherein the blind flange has a smaller diameter than a hole of the lower capsule and forms a passage for the product between both.

6. The dispenser device without air intake for nozzles for various types of flexible packaging, according to claim 2, wherein the plug, housed in the sealing seat, is guided by its cylindrical guide, which slides between radially turned inward teeth of the lower capsule, wherein the travel path of said plug is defined by the blind flange and the undersides of said radially turned inward teeth.

7. The dispenser device without air intake for nozzles for various types of flexible packaging, according to claim 1, wherein the elastic pad, after assembly, is compressed between the nozzle and the plug, keeping the plug pressed in the watertight position against the sealing seat.

8. The dispenser device without air intake for nozzles for various types of flexible packaging, according to claim 1, wherein that the plug is formed of parts capable of being compressed and stretched elastically.

9. The dispenser device without air intake for nozzles for various types of flexible packaging, according to claim 1, wherein the elastic pad comprises two integrated parts, being an upper horizontal ring and a lower vertical rod, both interconnected by arched and flexible links; the elastic pad is mounted inside the lower capsule with light compression, where the upper ring is supported against the lower side of the nozzle, while on the opposite side the vertical rod has its bottom extremity supported on the inside of the plug, axially aligned with a cylindrical guide of the plug.

10. The dispenser device without air intake for nozzles for various types of flexible packaging, according to claim 8, wherein the parts of the plug are formed from the group consisting of a spring, elastomeric parts, and/or flexible plastic parts.

* * * * *